US005873794A

United States Patent [19]

You

[11] Patent Number: 5,873,794

[45] Date of Patent: Feb. 23, 1999

[54] GOLF CLUB

[76] Inventor: Chin-San You, No. 6 Lane 477, Sec. 2,Feng-shyn Rd., Feng Yuan City, Taichung Hsien, Taiwan

[21] Appl. No.: 834,744

[22] Filed: Apr. 3, 1997

[51] Int. Cl.[6] ..... A63B 53/10

[52] U.S. Cl. ..... 473/319; 273/DIG. 23

[58] Field of Search ..... 473/319, 320, 473/321, 323, DIG. 23

[56] References Cited

U.S. PATENT DOCUMENTS

| | | | |
|---|---|---|---|
| 2,037,636 | 4/1936 | Lagerblade | 473/323 |
| 3,457,962 | 7/1969 | Shobert | 473/319 |
| 3,969,557 | 7/1976 | Jenks | 473/319 |
| 3,998,458 | 12/1976 | Inoue | 473/319 |
| 4,157,181 | 6/1979 | Cecka | 273/DIG. 23 |
| 5,022,652 | 6/1991 | Fenton | 473/323 |
| 5,192,073 | 3/1993 | Iwanaga | 473/289 |
| 5,653,646 | 8/1997 | Negishi | 473/319 |

*Primary Examiner*—Sebastiano Passaniti
*Assistant Examiner*—Stephen L. Blau
*Attorney, Agent, or Firm*—Browdy and Neimark

[57] ABSTRACT

A golf club is formed of a plurality of unit members of a plastic composite material reinforced by fiber braids. The unit members are tubular in shape and are connected end to end such that their axes are aligned and that the inner diameter and the outer diameter of the golf club are progressively increased in a steplike manner from the small end of the golf club towards the large end of the golf club.

6 Claims, 5 Drawing Sheets

GOLF CLUB

FIELD OF THE INVENTION

The present invention relates generally to a golf club, and more particularly to a stepped golf club.

BACKGROUND OF THE INVENTION

The conventional golf club is generally made of a metal material or a fiber-reinforced plastic composite material. The golf club is generally tapered from the grip end toward the fastening end which is fastened with the neck of the head. However, a golf club may be stepped and formed of a series of short parts which are different in diameter and are connected end to end.

The conventional tapered golf club of a fiber-reinforced plastic composite material is made of a fiber fabric, which is wound around a tapered metal rod and is then heated to take form. Such a method as described above is not applicable to the production of a stepped golf club in view of the fact that the tapered metal rod is not stepped, and that a gap is often formed between the inner side of the fiber fabric and the junction of two steps. The gap is filled with the air, which is inflated by heat to push the fiber braids of the fiber fabric to result in the deformation or even crack of the golf club. In addition, the trapped air is responsible for the formation of voids in the golf club, thereby undermining the structural strength of the golf club.

SUMMARY OF THE INVENTION

It is therefore the primary objective of the present invention to provide a stepped golf club having an excellent structural strength.

It is another objective of the present invention to provide a stepped golf club free from voids or cracks.

In keeping with the principle of the present invention, the foregoing objectives of the present invention are attained by a golf club having two ends of different diameters. The golf club is formed of a plurality of unit members of a plastic composite material reinforced by fiber braids. Each of the unit members is of a straight tubular construction and a predetermined thickness. The unit members are connected end to end such that their axes are aligned, and that the inner diameter and the outer diameter of the golf club are progressively increased in a steplike manner from the small end of the golf club towards the large end of the golf club.

The foregoing objectives, features and functions of the present invention will be more readily understood upon a thoughtful deliberation of the following detailed description of the embodiments of the present invention in conjunction with the accompanying drawings.

DETAILED DESCRIPTION OF THE INVENTION

Figure 2:
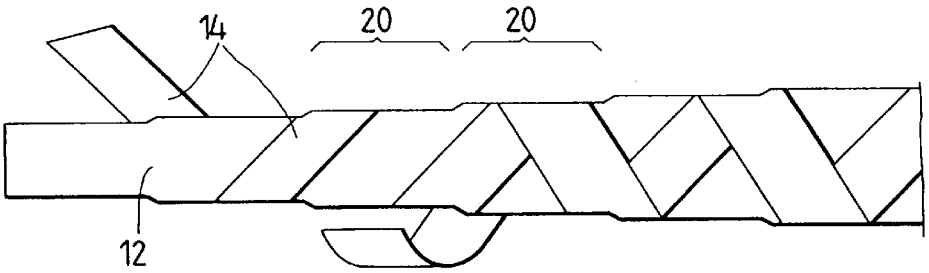
FIG. 2 shows a schematic view of the first preferred embodiment of the present invention.
Figure 3:
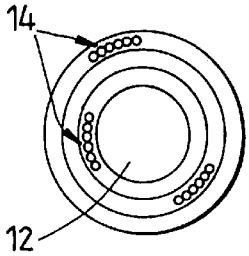
FIG. 3 shows a sectional view taken along the direction of a line 3—3 as shown in FIG. 1.
Figure 1:
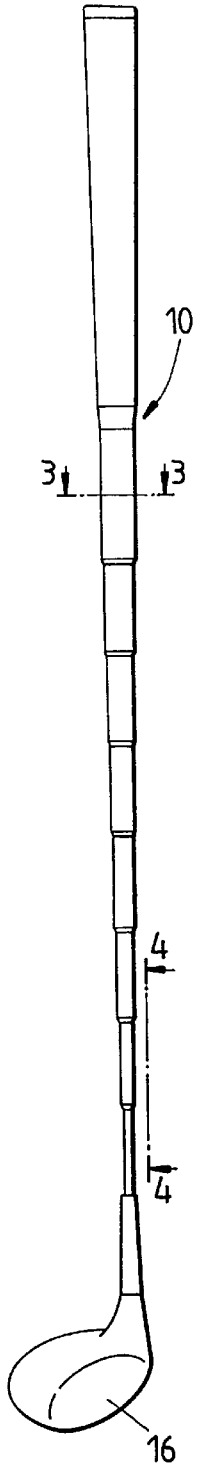
FIG. 1 shows a perspective view of a first preferred embodiment of the present invention.

As shown in FIGS. 1–4, a golf club 10 of the first preferred embodiment of the present invention has a small end and a large end greater in diameter than the small end. The small end is fastened with a head 16 while the large end is fastened with a grip. The golf club 10 is composed of a plurality of unit members 20 which are connected end to end such that their axes are aligned. Each of the unit members 20 is tubular in shape and has appropriate length and thickness. The unit members 20 are varied in diameter such that the diameters of the unit members are progressively increased from the small end towards the large end, and that the golf club 10 has a stepped profile.

In the process of making the golf club 10, a stepped rod 12 is wound thereon spirally with a fiber tape 14 of a width and a thickness in accordance with a predetermined pitch and an appropriate tension. Each fiber tape 14 shown in the FIGS. is made from a plurality of braids as shown for example in FIGS. 3 and 7. The fiber tape 14 of the stepped rod 12 can then be covered with OPP a plastic membrane that can be heat shrunk; before the fiber tape 14 is baked. The thermoplastic or thermosetting resin impregnating the fiber tape 14 enables the formation of the golf club 10.

The golf club 10 is provided with a head 16 fastened therewith. The shock wave transmitted from the head 16 towards the grip of the golf club 10 is effectively mitigated by virtue of the fact that the golf club 10 is tapered as well as stepped. In other words, the unit members 20 are tapered in terms of outer diameter and inner diameter.

Figure 4:
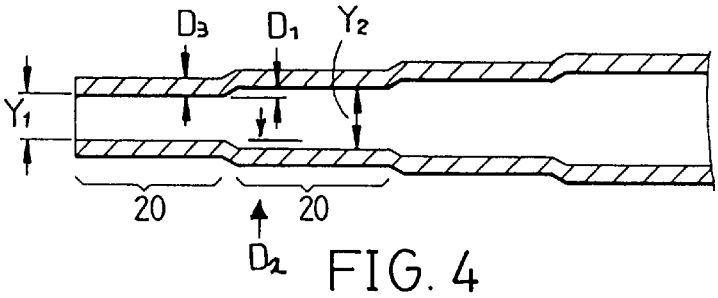
FIG. 4 shows a sectional view taken along the direction of a line 4—4 as shown in FIG. 1.
Figure 5:
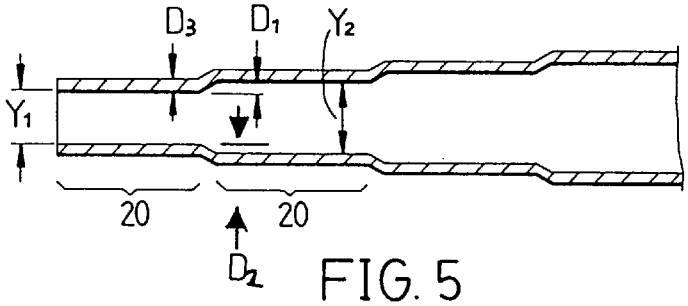
FIG. 5 shows a longitudinal sectional view of a second preferred embodiment of the present invention.

As shown in FIGS. 4 and 5, two adjoining unit members 20 located near the small end of the golf club 10 have inner diameters y1 while the two adjoining unit members 20 located near the large end of the golf club 10 have inner diameter y2. The diameter differentials D1 and D2 between y1 and y2 may be either smaller or larger than the thickness (D3) of the golf club 10. As the differential is smaller than the thickness, the golf club has a greater structural strength. On the other hand, when the differential is greater than the thickness, the golf club has a better shock-absorbing effect.

Figure 6:
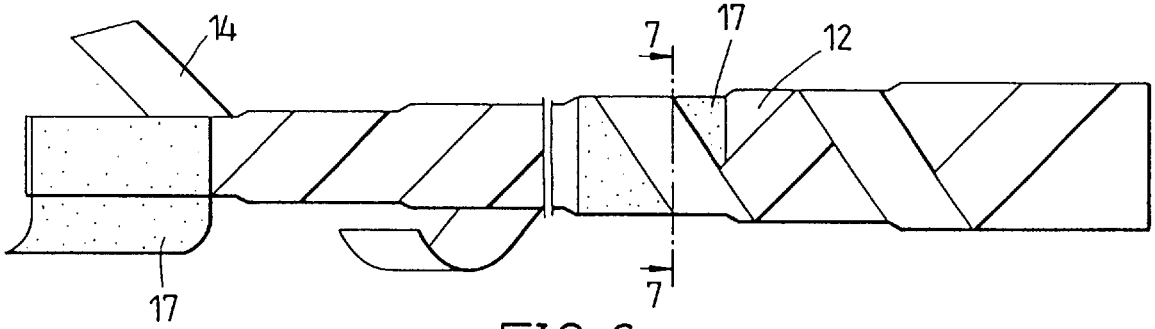
FIG. 6 shows a schematic view of a third preferred embodiment of the present invention.
Figure 7:
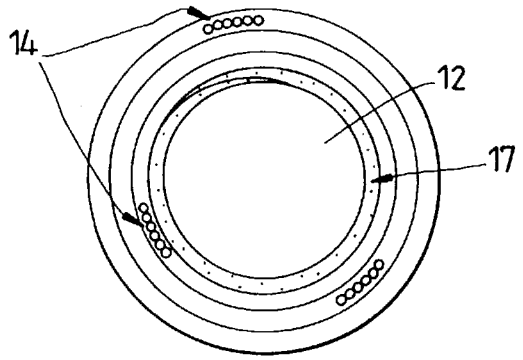
FIG. 7 shows a sectional view of a portion taken along the direction of a line 7—7 as shown in FIG. 6.
Figure 8:
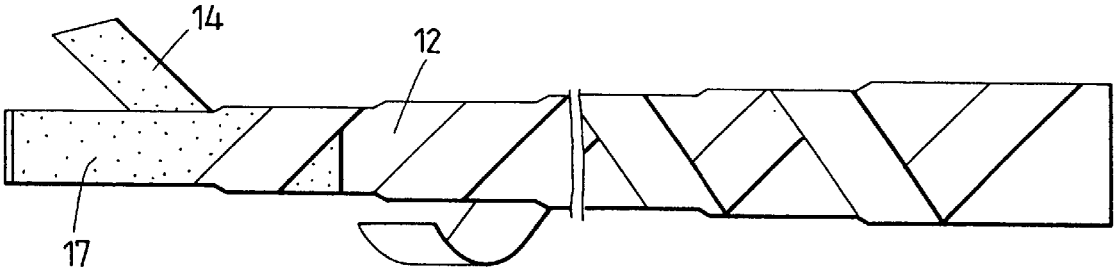
FIG. 8 shows a schematic view of a fourth preferred embodiment of the present invention.

As shown in FIGS. 6–8, the weak portion of the golf club 10 is reinforced by a reinforcing layer 17 of a fiber-reinforced plastic composite material. The reinforcing layer 17 is wound directly on the stepped rod 12 such that the reinforcing layer 17 is located at the small end, the large end, or the midsection of the golf club 10.

The reinforcing layer 17 has a length smaller than the length of the unit members 20. The reinforcing layer 17 can be wound in such a manner that it does not traverse the junction of two unit members 20, as shown in FIGS. 6 and 7, so as to avoid the formation of voids in the golf club 10. Alternatively, the reinforcing layer 17 may have any length and may be wound in such a manner that the reinforcing layer 17 traverses the junction of two unit members 20, as shown in FIG. 8.

The reinforcing layer 17 located at the small end of the golf club 10 is capable of minimizing the concentration of stress. In order to avoid the formation of voids in the golf club 10, conventionally the reinforcing layer 17 is forced to attach intimately to the stepped rod 12 by an appropriate pressure exerting on the reinforcing layer 17. Such a forced process of attaching the reinforcing member 17 to the stepped rod 12 is carried out manually and is therefore not cost-effective.

Figure 9:
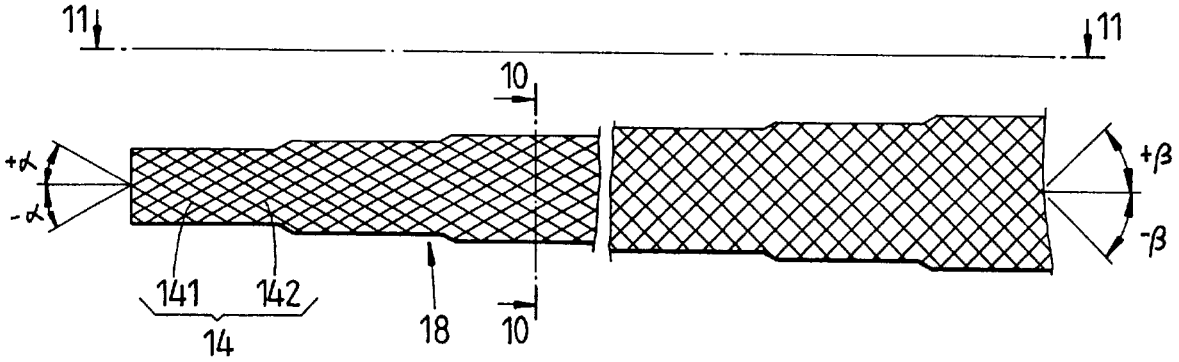
FIG. 9 shows a perspective view of a fifth preferred embodiment of the present invention.
Figure 10:
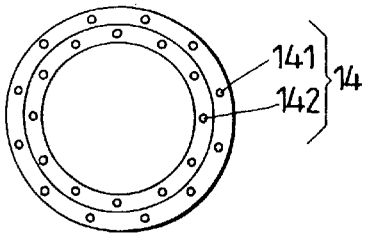
FIG. 10 shows a sectional view of a portion taken along a line 10—10 as shown in FIG. 9.
Figure 11:
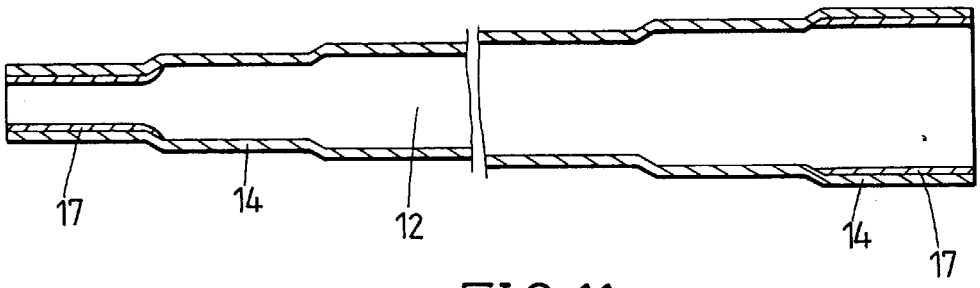
FIG. 11 shows a sectional view of a portion taken along a line 11—11 as shown in FIG. 9.

In order to ensure that the golf club 10 has a uniform structural strength, the fiber tape 14 must be wound on the stepped rod 12 back and forth such that the stepped rod 12 is provided thereon with several layers of the fiber tape 14. As previously noted in FIG. 10, the fiber tape 14 is composed of a plurality of fiber braids 141 or second fiber braids. However, as shown in FIG. 9 the cylindrical net 18 is formed by first fiber braids 141 and second fiber braids 142 which intersect at an angle $+\alpha$ a with the axis of the stepped rod 12 while the second fiber braids 142 form an angle $-\alpha$ with the axis of the stepped rod 12. Thus, the first fiber braids 141 and the second fiber braids 142 form together the cylindrical net 18, which can be fitted over the stepped rod 12. in addition, the cylindrical net 18, which is fitted over the stepped rod 12, is covered with OPP (not shown in the drawing) before they are baked. In the baking process, OPP is caused by heat to contract so as to force the cylindrical net 18 to become attached intimately to the stepped rod 12. As a result, the hollow golf club 10 has a stepped inner wall and a stepped outer wall. The small end and the large end of the golf club 10 may be respectively reinforced by the reinforcing layer 17. The cylindrical net 18 of an appropriate length may be used as the reinforcing layer 17. The length of the reinforcing layer 17 is smaller than the length of the corresponding unit member 20.

The first and the second fiber braids 141 and 142 of cylindrical net 18 located at the large end of the golf club 10 are subject to the expansion of the large end such that the angles formed by the axis of the stepped rod 12 and the first and the second fiber braids 141, 142 are thus enlarged to be $\pm\beta$ which are greater than the angles $\pm\alpha$ a formed by the axis of the stepped rod 12 and the first and the second fiber braids 141, 142 located at the small end of the golf club 10. As a result, the small end of the golf club 10 has a flexural rigidity greater than that of the large end of the golf club 10. Such feature is attained without subjecting the golf club 10 to additional treatment.

Figure 12:
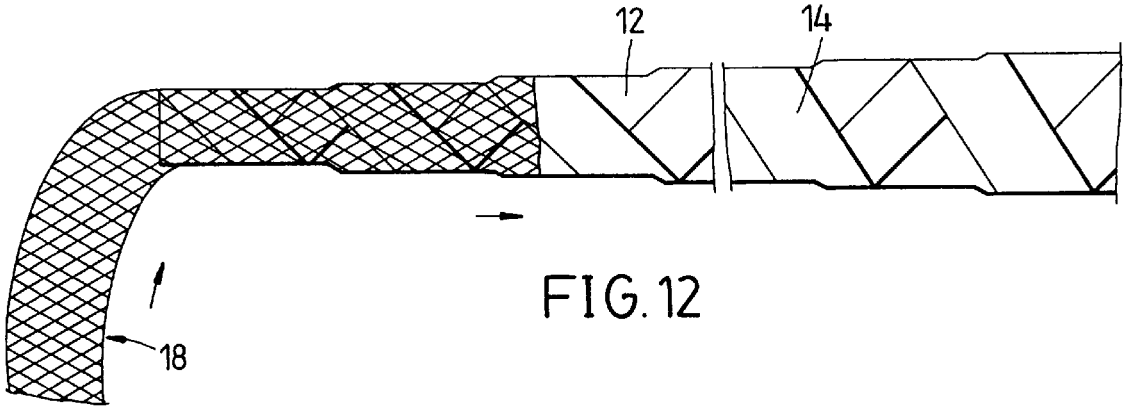
FIG. 12 shows a schematic view of a sixth preferred embodiment of the present invention.

As shown in FIG. 12, the stepped golf club 10 of the present invention may be formed of the fiber tape 14, which is wound on the stepped rod 12 before the stepped rod 12 is fitted into the cylindrical net 18 in conjunction with OPP. The golf club 10 is thus provided with a neat and attractive appearance.

Figure 13:
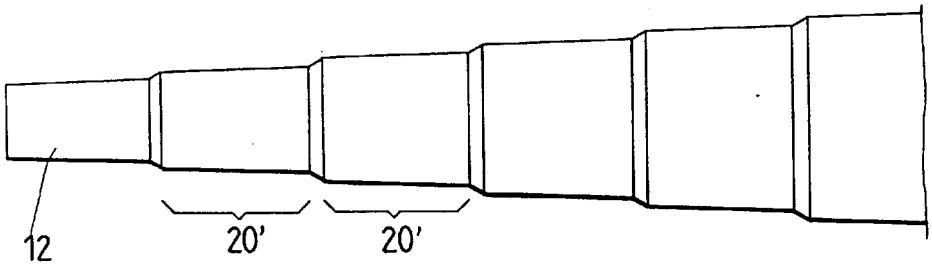
FIG. 13 shows a schematic view of a seventh preferred embodiment of the present invention.
Figure 14:
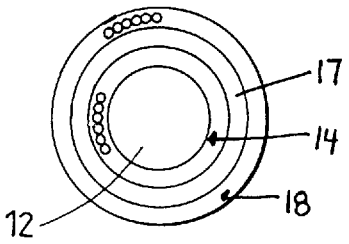
FIG. 14 shows a sectional view of an eighth preferred embodiment of the present invention.

In the event that the stepped golf club 10 is formed of two layers of the fiber tape 14, one of the unit members 20 may be reinforced with the reinforcing member 17, which may be located at the innermost layer of the golf club 10. In a further embodiment, the reinforcing member 17 can be located between an inner most layer of fiber tape 14 and an outer cylindrical net 18, as shown in FIG. 14. The unit member 20 may be of a hollow tubular construction, as shown in FIG. 2, or a conical construction, as shown in FIG. 13. The diametrical differential of two adjoining conical unit members 20 may be similar to those which are shown in FIGS. 4 and 5.

What is claimed is:

1. A golf club formed of a plurality of tubular unit members covered with a fiber tape-reinforced plastic composite material including a plurality of fiber braids such that said golf club has a small end and a large end greater in diameter than said small end, and that said unit members of different diameters are connected end to end to form said golf club having a stepped inner diameter and a steeped outer diameter, said golf club comprising a reinforcing layer of tubular construction and having a length smaller than a length of said unit member corresponding in location to said reinforcing layer, said reinforcing layer being located such that said reinforcing layer does not traverse two adjoining unit members.

2. The golf club as defined in claim 1, wherein two adjoining unit members have an inner diametrical differential smaller than a thickness of any one of said two adjoining unit members.

3. The golf club as defined in claim 1, wherein two adjoining unit members have an inner diametrical differential greater than a thickness of any one of said two adjoining unit members.

4. The golf club as defined in claim 1, wherein said reinforcing layer is a fabric made of a fiber-reinforced plastic composite material and is wound in an innermost layer of said golf club.

5. The golf club as defined in claim 1, wherein said reinforcing layer is a cylindrical net formed of a plurality of fiber braids by weaving.

6. A golf club formed of a plurality of tubular unit members covered with a fiber tape-reinforced plastic composite material including a plurality of fiber braids such that said golf club has a small end and a large end greater in diameter than said small end, and that said unit members of different diameters are connected end to end to form said golf club having a stepped inner diameter and a stepped outer diameter;

said golf club comprising a reinforcing layer of tubular construction and located at a junction between two adjoining unit members.

* * * * *